United States Patent [19]

Bergholtz

[11] 4,079,603

[45] Mar. 21, 1978

[54] APPARATUS FOR LIQUID TREATMENT, PARTICULARLY FOR TEXTILE MATERIAL DYEING

[75] Inventor: Niels Bergholtz, Kinna, Sweden

[73] Assignee: Niels Bergholtz & Company K/B, Kinna, Sweden

[21] Appl. No.: 722,374

[22] Filed: Sep. 13, 1976

Related U.S. Application Data

[63] Continuation of Ser. No. 514,216, Oct. 11, 1974, abandoned.

[30] Foreign Application Priority Data

Oct. 16, 1973 Sweden ..... 7314006

[51] Int. Cl.[2] ..... D06B 23/00

[52] U.S. Cl. ..... 68/15

[58] Field of Search ..... 68/15, 189, 5 C, 7, 68/177, 178, 183, 187, 194, 207, 16

[56] References Cited

U.S. PATENT DOCUMENTS

| | | | |
|---|---|---|---|
| 981,380 | 1/1911 | Chaumat | 68/15 |
| 1,265,332 | 5/1918 | Holt | 68/189 |
| 2,215,604 | 9/1940 | Cronkhite et al. | 68/15 |
| 3,754,417 | 8/1973 | Jamieson | 68/15 |

FOREIGN PATENT DOCUMENTS

| | | | |
|---|---|---|---|
| 170,956 | 11/1921 | United Kingdom | 68/189 |

*Primary Examiner*—Philip R. Coe

*Attorney, Agent, or Firm*—Holman & Stern

[57] ABSTRACT

Improvements in textile material dyeing apparatuses in which the liquid used for dyeing the material is circulated or contained in a vessel, and the material is penetrated by the liquid. It is necessary to heat or cool the liquid and the heating or the cooling is effected indirectly by a heating or cooling medium which is fed into a chamber in heat exchanging contact with the liquid in the vessel. The chamber is open at the top end thereof and communicates at said end with the vessel. Thus, the pressure between the chamber and the vessel will be equalized and there is no need to use expander or similar means between the chamber and the vessel. The problem pertaining to stresses in mechanical connection will be reduced greatly and the construction of the apparatus simplified. By forming the chamber as disclosed in the drawings in which several embodiments have been shown, the effective heat exchange area between the chamber and the vessel will be large for giving a maximum of efficiency. The influence of the heating or cooling medium on the processing liquid is negligible since the effective flow zone between the medium and the liquid can be made small by properly designing the top of the chamber, the upper part of the vessel and the distribution pipes thereof. Further on, the ratio processing liquid to textile material can be kept relatively small compared to prior art apparatuses in which the processing liquid is indirectly heated.

2 Claims, 9 Drawing Figures

APPARATUS FOR LIQUID TREATMENT, PARTICULARLY FOR TEXTILE MATERIAL DYEING

This is a continuation of application Ser. No. 514,216 filed Oct. 11, 1974, now abandoned.

BACKGROUND OF THE INVENTION

The present invention relates to an apparatus for liquid treatment, for instance textile material dyeing in a vessel or several communicating vessels in which a processing liquid can be caused to flow through the textile material, or the textile material can be moved through the processing liquid, and the textile material vessel or vessels are separated from a chamber containing a heating or cooling medium, the arrangement being such that the heating or cooling medium chamber is open at the top end thereof and communicates with the vessel, and that openings for dispersing said heating or cooling medium are arranged at the upper portion of said chamber, and that at least one outlet is arranged at the bottom of the chamber.

When dyeing textile material, particularly synthetic material, the temperature of the processing bath is to be raised to a temperature level of, for instance, 105°–130° C. Previously, the heating has been carried out either indirectly by arranging a heat exchanger in the pressure vessel, with the heat exchanger being surrounded by processing liquid, or by arranging heat exchangers directly into the circulation path of the processing liquid. When heating indirectly, a relatively large volume of liquid is required since the liquid has to flow around the heat exchanger pipes and a bath ratio of 1:10 to 1:12 is obtained, i.e. 1 kg textile material requires 10–12 l processing liquid. From an economical and environmental aspect, large liquid volumes are unfavorable since said volumes require greater amounts of energy for heating and imply a greater amount of discharge water which is to be purified. A further drawback of heating indirectly is the nonhomogenous heat distribution.

Further on, when heating directly, particular constructive measures are to be taken for making possible the cooling of the processing bath since it is not possible to add a cooling medium directly to the processing bath.

OBJECT AND SUMMARY OF THE INVENTION

The object of the present invention is to provide a dyeing apparatus which has a very favorable bath ratio, a very homogenous temperature distribution and is structurally so designed that mechanical tensions between the heating- or cooling medium chamber and the processing vessel or vessels do not appear or only exist at a negligible level. Such object has been achieved by making the vessel open at its upper end and by designing the vessel so that it communicates with the chamber, and by arranging at the upper part of the chamber, openings for diffusing or dispersing a heating or cooling medium and by arranging at least one outlet at the bottom of the chamber.

Some embodiments of the invention are disclosed on the enclosed drawings.

Figure 1:
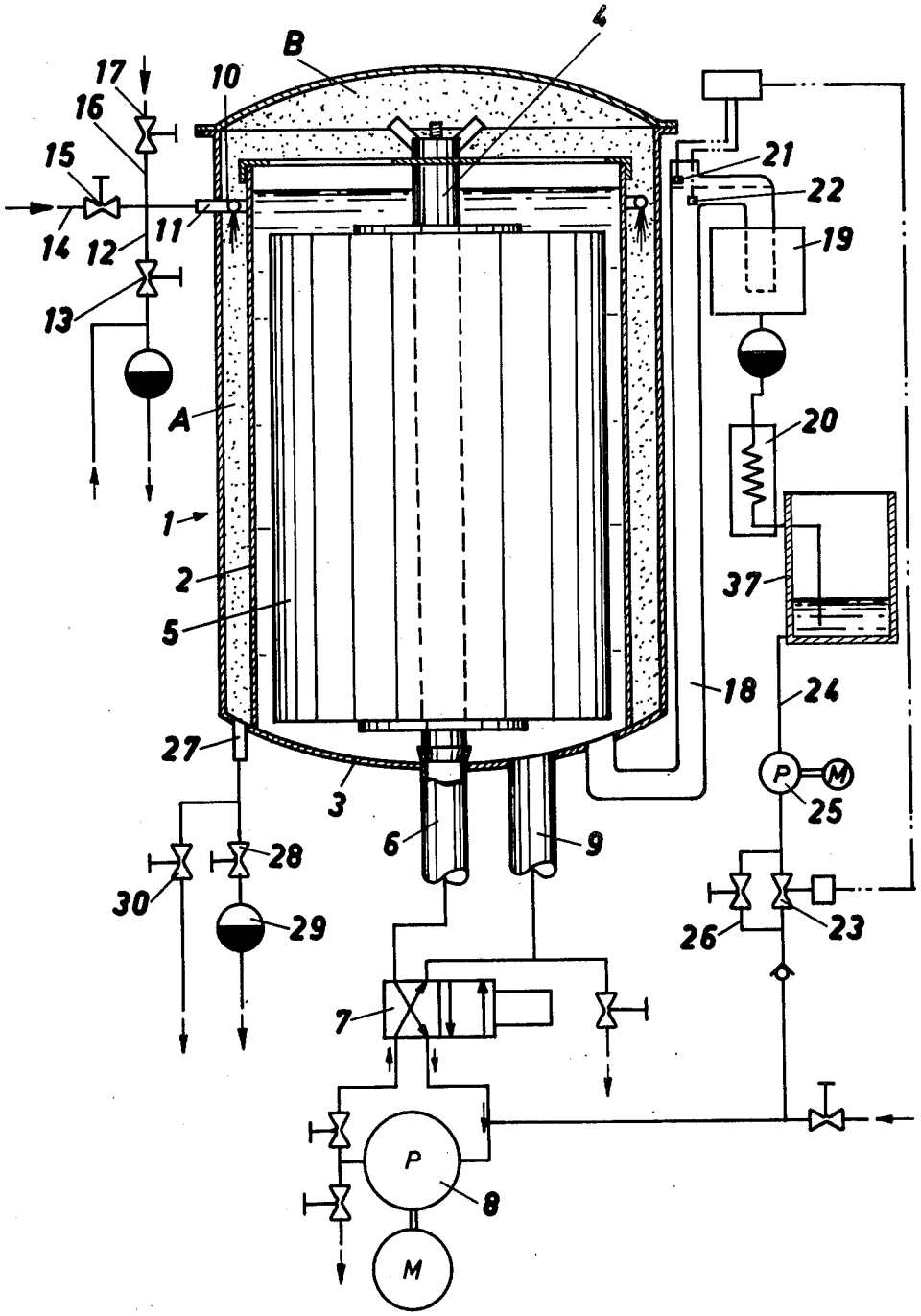
FIG. 1 is a section through a dyeing apparatus having a fixed vessel for receiving textile material.

In the embodiment according to FIG. 1, the dyeing apparatus comprises a pressure tank or vessel 1, a so called autoclave, and an internal vessel 2 arranged inside the autoclave and having a bottom 3 common with the pressure tank. One or several material carriers 4 in the form of perforated pipes are arranged inside the vessel 2, and a textile material 5 is wound on said carrier. The material carrier 4 is sealingly connected to an inlet or outlet pipe 6, with said pipe being connected to a pump 8 through a four way valve 7. A second inlet or outlet 9 is arranged in the vessel bottom 3 and is connected to the pump 8 through said four way valve 7. The vessel 2 is open at the top thereof and communicates with a space, or chamber A between the vessel 2 and the pressure tank 1, with such communication being obtained through a space or chamber B at the top part of the tank 1, between the cover of the tank and the free liquid surface in the tank.

At the upper part of the pressure tank 1 approximately at a level corresponding to the top edge of the vessel 2, an annular distribution pipe 10 is arranged and provided with openings or nozzles along the entire length of the pipe and preferably directed towards the space or chamber A. Through a connection piece 11 extending through the tank wall, the pipe 10 is connected to a steam conduit 12 having a shut down valve 13, to a water conduit 14 having a control valve 15 and a conduit 16 for compressed air having a shut down valve 17, respectively. Thus, the space or the chamber A acts as a heat exchanger.

From the tank bottom 3, an over flow pipe 18 extends and is arranged parallel to the tank 1. The pipe 18 has a maximum level outlet opening into an over flow tank 19, with a cooler 20 and an expansion tank 37 being connected to the over flow tank. At a level somewhat below the top edge of the vessel 2, in the upper portion of the over flow pipe, with two gauges or sensors 21 and 22 are arranged, the sensor 21 controlling a valve 23 in an outlet conduit 24 from the expansion tank 37, and the sensor 22 controlling a pump 25 arranged in the conduit 24 between the tank and the valve 23. The pump 25 continuously pumps a minor amount of processing liquid to the suction side of the pump 8 through a by pass conduit 26. The object of the sensors 21 and 22 is to maintain the liquid level in the vessel 2 at a substantially constant level.

In the portion of the bottom 3, associated with the chamber A, an outlet conduit 27 having a shut down valve 28 and a water separator 29 is arranged together with a branch conduit having a shut down valve 30.

When liquid treating, for instance, when textile material dyeing is carried out, the processing liquid will fill the vessel 2 up to a level somewhat above the textile material, and such level is maintained constant by means of the sensors 21 and 22. The pump 8 feeds processing liquid through the textile material in a direction from the inside to the outside and from the outside to the inside, respectively. The temperature of the processing liquid is increased by admitting a heating medium, for instance steam, into the space or chamber A, with said medium condensating against the vessel wall. The condensate is discharged through the outlet 27. The steam will also fill up the space above the processing liquid, the surface of which, however, is considerably less than the external circumferential surface of the vessel 2 and the internal circumferential surface of the pressure tank 1, so only a small amount of condensate will be added to the processing liquid.

If the liquid level in the vessel 2 falls to the level of the sensor 22, the valve 23 will open and a greater volume of liquid will be supplied to the pump 8. If the liquid level raises to the level of the sensor 21, the pump 25 is stopped.

For avoiding cavitation in the pump 8, for instance, when the steam pressure is not sufficient due to the heating being carried out slowly at the beginning of a treating process, an increased pressure within the tank 1 and the vessel 2, can be obtained by feeding compressed air through the conduit 14 and the valve 15. If the pressure within the tank 1 is set to, for instance, 0.5 kg/cm$^2$, a heating to 110° C is guaranteed and the steam pressure will be reduced to 4.5 kg/cm$^2$. By monitoring the pressure in relation to steam formation and desired temperature increase, the cavitation risks can be avoided by means of said compressed air compensation when further heating is effected.

Since the pressure in the pressure tank 1 is substantially equal to the pressure in the vessel 2, mechanical stresses are avoided in the construction and expansion members, box sealings or the like do not have to be provided.

Figure 3:
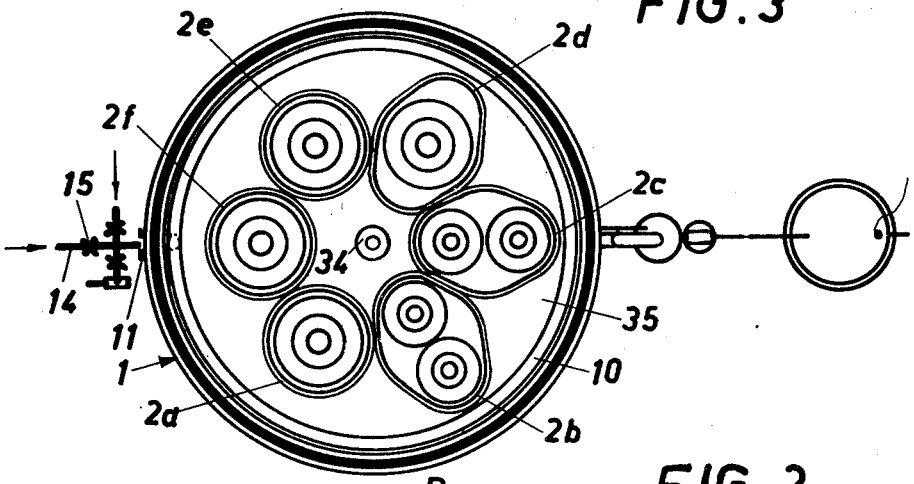
FIG. 3 shows the dyeing apparatus according to FIG. 2 from above and provided with two alternatively formed groups of processing vessels.
Figure 2:
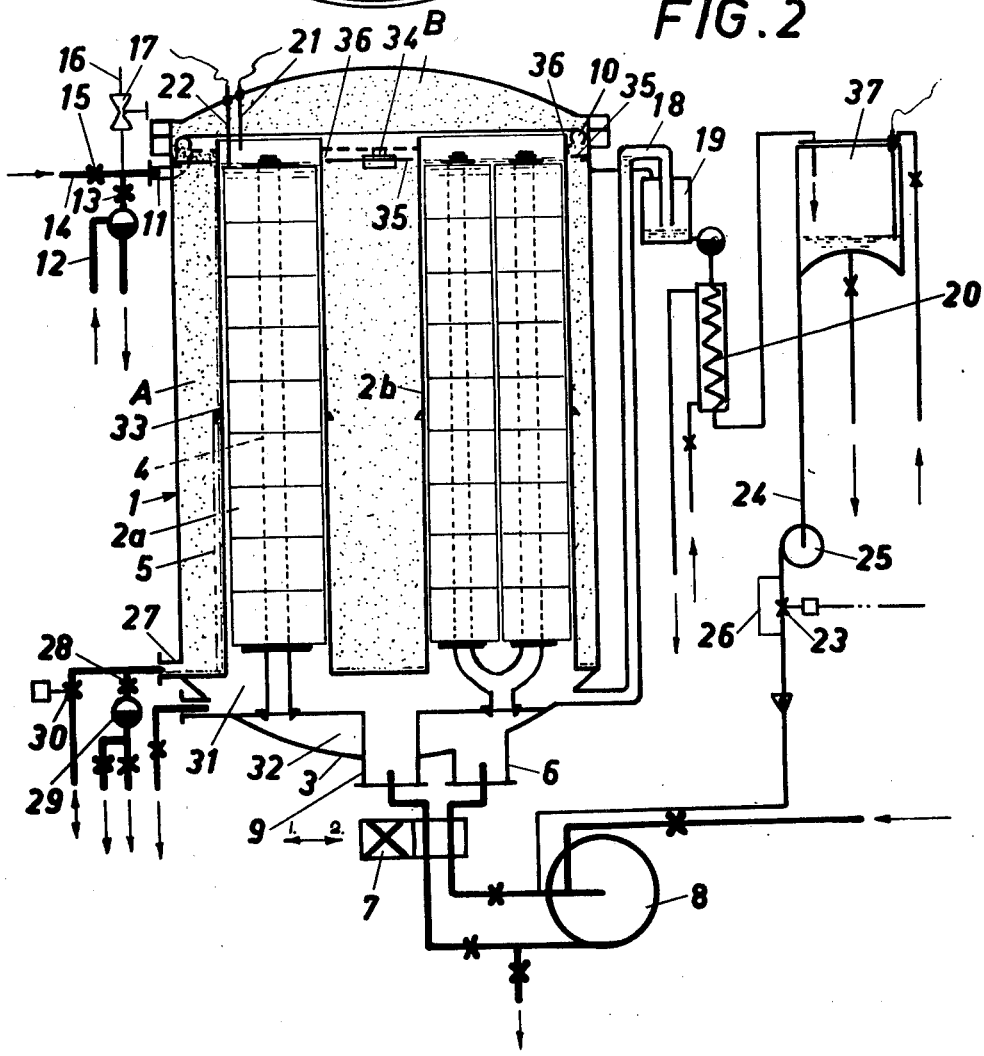
FIG. 2 is a corresponding section through a dyeing apparatus having several vessels for receiving cross spools, for instance.

In the embodiment according to FIGS. 2 and 3, the textile material which, for instance, is in the form of cross spools, is placed in a number of vessels *2a, 2b, 2c,* etc., having a tubular shape. The tubes can have a circular cross section for receiving a pile of cross rolls, or an oval cross section for receiving a pile of cross rolls having a longer diameter or alternatively for receiving two piles of cross spools having a shorter diameter. Preferably, the tubes *2a, 2b, 2c,* etc. are conically shaped, so that they are widened in a direction towards a distribution chamber 31. This means that substantially one and the same flow rate is obtained along the entire pile.

For supplying processing liquid to the vessels *2a, 2b, 2c,* etc. in the bottom portion of the tank 1, two separate distribution chambers 31 and 32 are arranged, with the first chamber 31 communicating with the vessels *2a, 2b,* etc. and the second chamber 32 communicating with the material carriers 4. For increasing the possibilities of the steam to condensate, the tubes *2a, 2b,* etc., can be provided with one or several sleeves in the form of conical rings, with said sleeves urging the condensate flowing on the outside of the tubes out of contact with the tube side so that said side is exposed to the steam and the steam dissipates its heat contents to the colder tube wall.

Instead of arranging level sensors 21, 22 in the over flow pipe 18, as disclosed in FIG. 1, said sensors also can be arranged directly in any of the vessels *2a, 2b, 2c,* etc, as disclosed in FIG. 2.

At some distance from the distribution pipe 10 and the openings thereof, a partition wall 35 is arranged and is so formed that narrow apertures or slots 36 are formed adjacent the vessels *2a, 2b,* etc., for the passage of the steam to the heat exchanger space or chamber A. If desired, the apertures or slots 36 can be dimensioned for giving a higher pressure in the space or chamber B of the pressure tank 1 located above the partition wall 35.

For avoiding cavitation in the pump 8, which can occur when the static pressure of the processing liquid is at a level below the steam formation pressure, steam is supplied to the space or chamber B. The steam will pass through the narrow slots 36 and will condense against the tube walls. Therefore, the steam pressure in the chamber A will be lower than the pressure in the space B, in which condensation is at a minimum. In this way, a higher pressure is obtained in the chamber B, and the pressure acts on the free liquid surface in the tubes *2a, 2b,* etc and no cavitation need to be expected in the pump.

The steam pressure used should, of course, be higher than the desired static pressure. If a slow heating is desired, the steam volume can be too small. For obtaining the desired static pressure in the chamber B, compressed air is to be supplied, and the combined pressure of steam and air should correspond to the static pressure set for avoiding cavitation. The addition of compressed air in the apparatus must, of course, not exceed the steam pressure in the steam conduit. When the temperature of the processing bath increases, the condensation temperature will also increase and so will the steam pressure in the chambers A and B. After the heating of the steam, the pressure reduction, due to heat transfer and condensation, is to be compensated by compressed air.

For obtaining a pressure difference between the chambers A and B, it can be necessary to make the slots 36 very narrow so that only a limited amount of steam passes through said slots. As soon as the desired over pressure is obtained in the chamber B, a pressure controlling valve 34 will be opened so that a larger quantity of steam can flow to the chamber A. Instead of using steam as a heating medium, it is also possible to use hot water, and in this case, the slots 36 will be larger so that the necessary heat exchange can take place. The static pressure in the two chambers is maintained by means of compressed air. As in the case of steam, the hot water is discharged through the outlet 27 and the valve 30, with the valve 28 being closed.

When the processing bath is to be cooled, cold water is supplied through the conduit 14 and the valve 15, with the pipe 10 and the slots 36 distributing the water homogenously along the tubes. In the temperature range between 130°–150° C, steam formation will occur along the tube walls, and the condensate will be discharged through the outlet 27. The pressure drop will be compensated by supplying compressed air through the conduit 16 and the valve 17.

Figure 4:
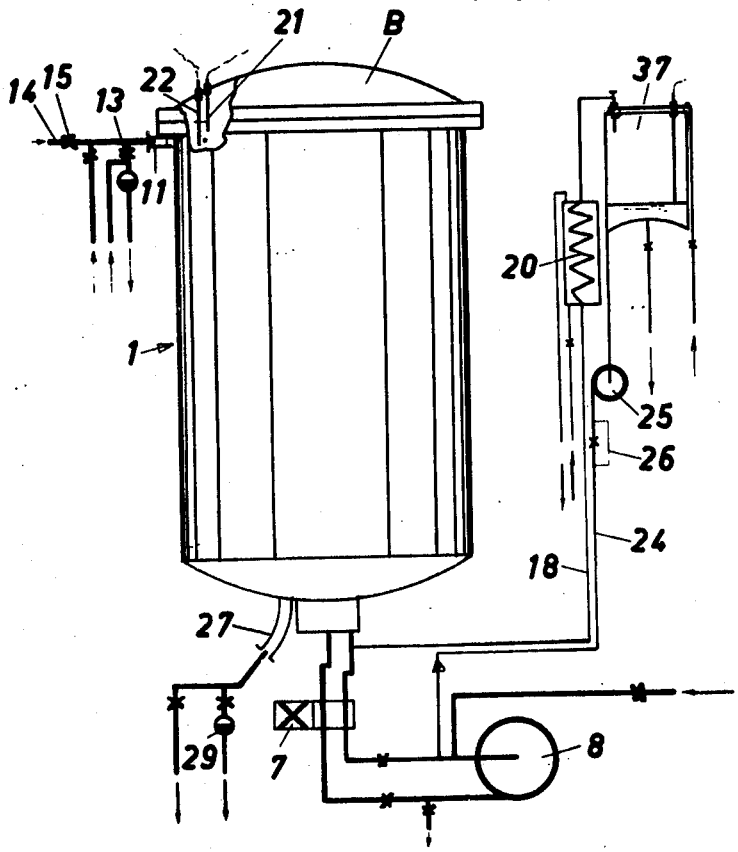
FIG. 4 is a side view of a modified dyeing apparatus according to the invention.
Figure 5:
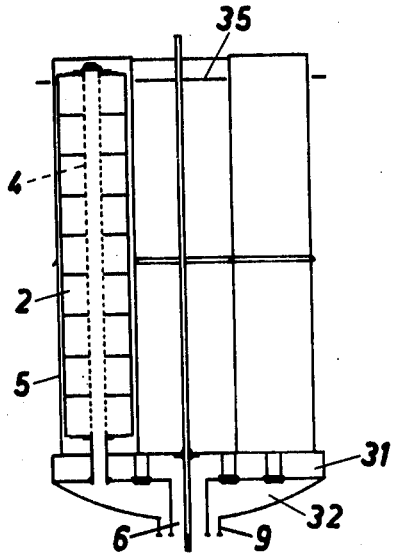
FIG. 5 shows partially in section, a detachable insert for the apparatus according to FIG. 4.

The embodiment according to FIGS. 4 and 5 distinguishes over the embodiments of FIGS. 1–3 in that the vessels 2*a*, 2*b*, 2*c*, etc together with the distribution chambers 31 and 32 form a unit which can be lifted out of the tank 1. This embodiment is particularly suited when several units having vessels adapted for different textile materials are to be used and in this case, greater flexibility, i.e. better possibilities of adaption to different textile materials are obtained.

The liquid level control in the vessel or vessels can be obtained in a number of different ways, for instance electrically by means of non contacting or sensing gauges or mechanically in a way known per se.

Instead of being built into the tank 1, the distribution chambers 31 and 32 can be located outside the tank and, for instance, can have the shape of annular distribution conduits.

Figure 6:
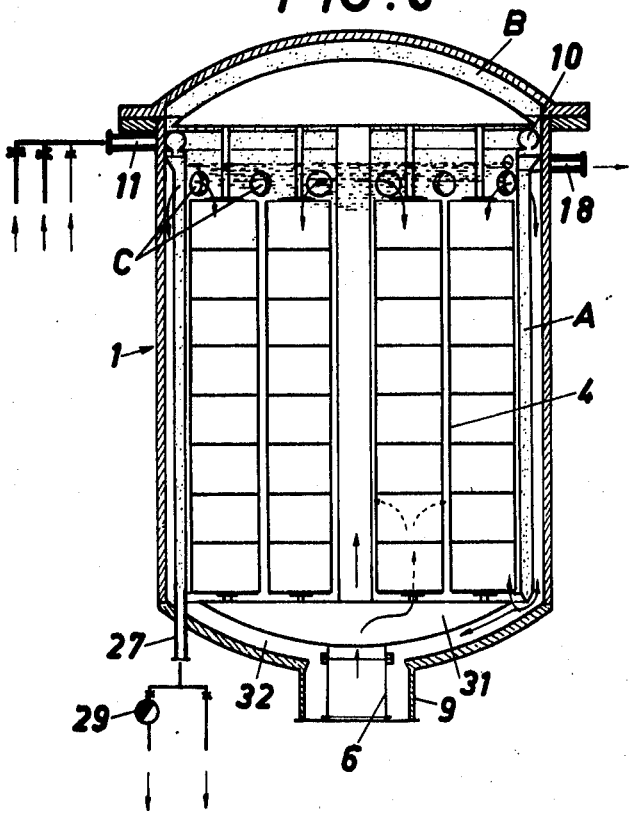
FIG. 6 shows an embodiment in which the heating or cooling medium is double walled and in which, basically, the chamber is immersed in the processing liquid of the vessel.

In FIG. 6 an alternative embodiment of the heating or cooling medium chamber or space is disclosed. Basically, in this embodiment, the chamber A is defined by concentric cylindrical envelop surfaces, and at the upper portion thereof, the chamber is open and except for an outlet as in FIGS. 1–4, the chamber is closed at the bottom portion. In this embodiment, the processing liquid surrounds the chamber A along two envelop surfaces, and the effective heat exchanger surface will be increased. In order to allow a flow of processing liquid from the space inside the chamber A to the space surrounding the chamber, passages C through the chamber are arranged at the upper portion of the chamber.

Figure 7:
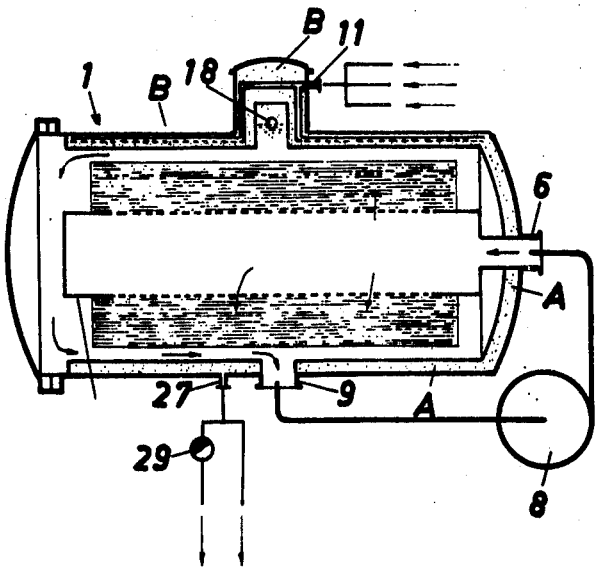
FIG. 7 shows a chamber having horizontally arranged textile material, i.e. the support means carrying the material extends substantially along the horizontal longitudinal axes of the vessel.

In FIG. 7, there is disclosed a possibility for applying the inventive concept to horizontally arranged vessels. In this figure, similar or equivalent elements have the same reference numerals as corresponding elements in the preceding embodiments.

Figure 8:
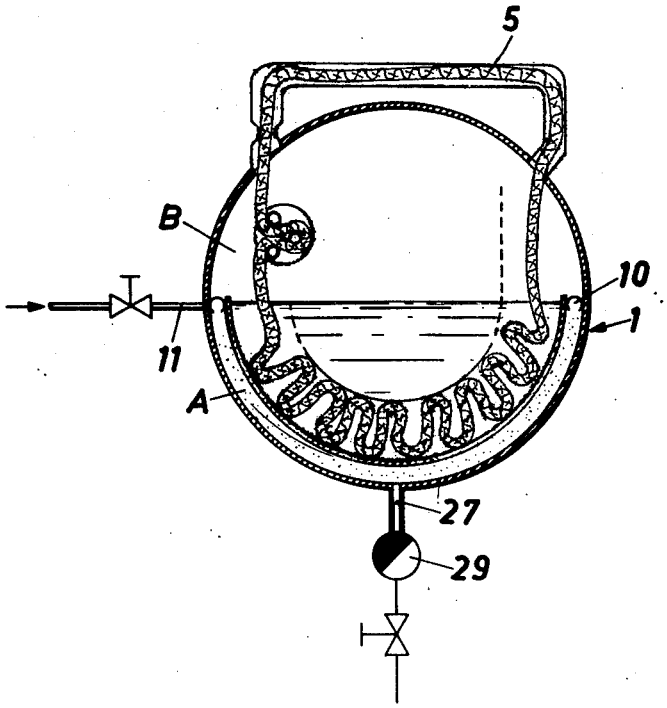
FIG. 8 shows an embodiment according to the invention applied to a "Caston County"-apparatus.

In FIG. 8, an embodiment is shown in which a material path is fed through a processing bath surrounded by a chamber A for a heating or cooling medium, in the present embodiment steam.

Due to the fact that at the upper portion of the chamber A, in this embodiment, the chamber communicates with the processing liquid vessel, the same advantages as previously described as to eliminated or decreased tensions or stresses are obtained.

Figure 9:
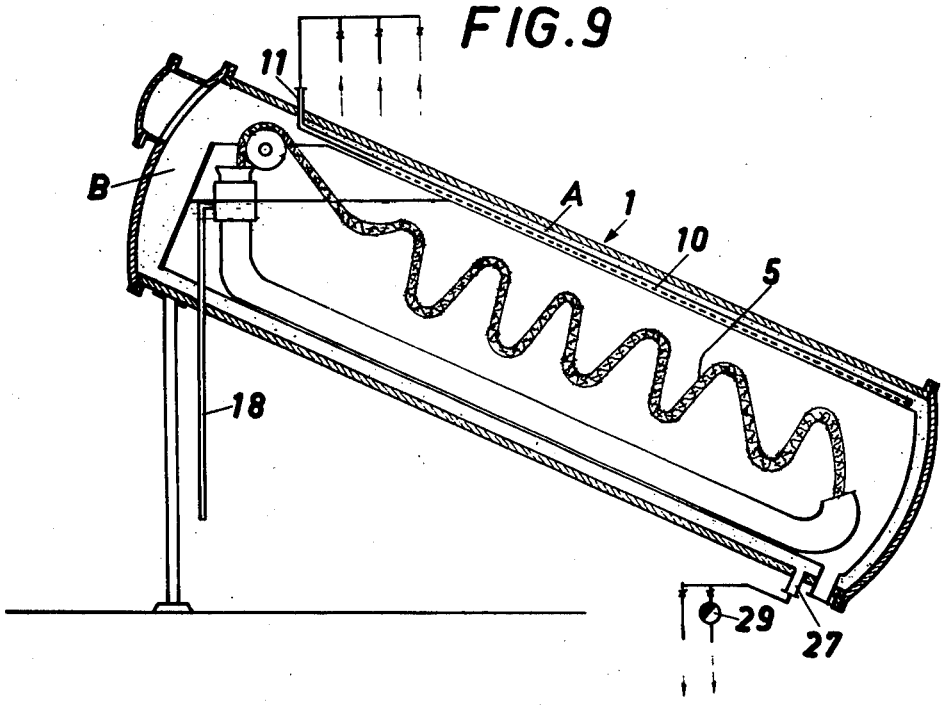
FIG. 9 shows an alternative embodiment of an apparatus of basically the same kind as in FIG. 8.

Finally, in FIG. 9, an alternative embodiment of the apparatus according to FIG. 8 is disclosed. The tank 1 is inclined in relation to the horizontal plane and the chamber A is defined by two concentric cylindrical surfaces and extends a substantially longer distance along the tank than in to FIG. 8. The heat exchange will be more efficient, and since the chamber B will be smaller than in the previous embodiment, there is also obtained the advantage that the processing liquid will be less influenced by the heating or cooling medium.

What I claim is:

1. In a liquid treatment apparatus, particularly textile dyeing apparatus, comprising at least one vessel for containing a textile material and in which a relative movement between a processing liquid and the textile material is effected, means providing a chamber separated from the vessel for containing a heat-exchange medium in heat-exchanging contact with said vessel, said chamber having a top and bottom, said chamber being open at the top and arranged to communicate with the vessel at the top so that said chamber is in direct communication with said vessel during a liquid treatment of the textile material in said vessel, said chamber having an inlet for the heat-exchange medium, means providing openings at the top of the chamber for dispersing the heat-exchange medium from the inlet, and, at least one outlet for the heat-exchange medium at the bottom of the chamber, means for controlling and maintaining constant the liquid level in the vessel at a level above the textile material, said means for controlling the liquid level including a maximum level outlet and gauge means arranged for sensing the desired maximum and minimum liquid levels, and source means of compressed air connected to the vessel for creating a static overpressure in the vessel.

2. The liquid treatment apparatus as claimed in claim 1, in which the vessel has an external wall and said chamber is defined by an annularly-shaped channel located at some distance from and inside the external wall of the vessel.

* * * * *